US005234046A

United States Patent [19]

Kuhn et al.

[11] Patent Number: 5,234,046

[45] Date of Patent: Aug. 10, 1993

[54] METHOD OF ELIMINATING SHRINKAGE POROSITY DEFECTS IN THE FORMATION OF CAST MOLTEN METAL ARTICLES USING POLYSTYRENE CHILL

[75] Inventors: John W. Kuhn, Bristol; Richard J. Wylie; Jerome D. VanAelst, both of Wabash, all of Ind.

[73] Assignee: CMI International, Inc., Southfield, Mich.

[21] Appl. No.: 921,509

[22] Filed: Jul. 29, 1992

[51] Int. Cl.[5] ..... B22D 15/00

[52] U.S. Cl. ..... 164/127; 164/365

[58] Field of Search ..... 164/122, 125, 127, 349, 164/364, 365

[56] References Cited

U.S. PATENT DOCUMENTS

| | | | |
|---|---|---|---|
| 2,294,170 | 8/1942 | Francis et al. . | |
| 2,750,641 | 6/1956 | Raible . | |
| 3,204,303 | 9/1965 | Chandley . | |
| 4,690,196 | 9/1987 | Vernay | 164/349 |
| 4,691,754 | 9/1987 | Trumbauer et al. | 164/369 |
| 4,706,732 | 11/1987 | Ruhlandt et al. . | |
| 4,742,863 | 5/1988 | Witt | 164/349 |

FOREIGN PATENT DOCUMENTS

| | | | |
|---|---|---|---|
| 0272429 | 10/1989 | Fed. Rep. of Germany | 164/97 |
| 0117872 | 9/1981 | Japan | 164/97 |
| 0126943 | 6/1986 | Japan | 164/340 |

*Primary Examiner*—Mark Rosenbaum
*Assistant Examiner*—James Miner
*Attorney, Agent, or Firm*—Reising, Ethington, Barnard, Perry & Milton

[57] ABSTRACT

A method of eliminating solidification shrinkage porosity defects in cast metal articles includes disposing an expanded polystyrene chill (36) within a preformed mold cavity (26) and thereafter introducing molten metal into the cavity (26) and vaporizing the chill member (36), whereby the heat of vaporization rapidly cools a localized region of the molten metal adjacent the chill member and accelerates solidification thereof enabling remote still-molten metal to feed solidification shrinkage in this region and prevent the formation of porosity defects that would otherwise result.

7 Claims, 1 Drawing Sheet

METHOD OF ELIMINATING SHRINKAGE POROSITY DEFECTS IN THE FORMATION OF CAST MOLTEN METAL ARTICLES USING POLYSTYRENE CHILL

BACKGROUND OF THE INVENTION

1. Field of the Invention

This invention relates to a method for casting molten metal articles within a casting mold utilizing a vaporizable chill member disposed within the mold for controlling solidification of the metal so as to reduce the formation of solidification shrinkage porosity defects within the resultant cast article.

2. Description of the Related Prior Art

As molten metal is cast into a mold and begins to cool, the outer portion of the casting adjacent the mold wall solidifies and forms a skin or shell of solidified metal essentially capsulating the remaining molten metal therewithin and fixing the volume of the casting. As the remaining molten metal further cools and solidifies, it shrinks and, if left uncontrolled, creates shrinkage holes or voids internally within the resultant casting.

To compensate for this shrinkage, many known casting processes are known to employ some source of additional molten metal (i.e., a riser) which is fed into the various sections of the casting as they solidify. This additional metal fills the shrinkage voids as they are formed and produces a sound, porosity-free cast article.

For the riser to be effective, it is important to control the solidification rates of the various sections of the casting or else the thin sections will naturally cool and solidify sooner than the thick sections and freeze off the central, still-molten regions of the thicker sections from access to the additional riser metal.

The broad concept of using a chill to accelerate solidification of select regions of a casting is known to the art as exemplified by the U.S. Pat. No. 2,294,170 to Francis et al, granted Aug. 25, 1942. This patent teaches delivering solid metal chill bodies into the mold after the molten metal has been introduced therein in order to increase the solidification rate of the center of the casting. These chill bodies either melt and combine with the surrounding molten metal or remain solid and become bonded to the casting metal as it solidifies. Both may be undesirable, as dissolving the chill bodies may contaminate the melt and allowing the chills to remain in tact could affect the integrity of the casting.

The U.S. Pat. Nos. 2,750,641 to Raible, granted Jun. 19, 1956; and 4,706,732 to Ruhlandt et at. granted Nov. 17, 1987, disclose using a metal chill body for controlling the solidification rate of various sections of a casting. These chill bodies, however, either remain in tact with the casting or must be removed after casting.

Thus, there is a need in the industry for a casting process utilizing a chill which effectively accelerates solidification of select regions of a cast article as it solidifies to eliminate solidification shrinkage but does not contaminate the casting metal, affect the integrity of the casting, nor add to the expense of manufacturing the casting by requiring removal of the chill bodies after casting.

SUMMARY OF THE INVENTION AND ADVANTAGES

A method of eliminating solidification shrinkage porosity defects in the casting of metal articles comprises the steps of: preparing a casting mold with a mold cavity formed therein, disposing a vaporizable chill member having a characteristic heat of vaporization within the preformed mold cavity and thereafter introducing molten metal into the mold cavity and vaporizing the chill member, whereby the heat of vaporization of the chill member rapidly cools a localized region of the molten metal adjacent the chill member and accelerates solidification thereof enabling remote still-molten metal within the cavity to feed solidification shrinkage of the localized region during solidification thereof to thereby eliminate the formation of solidification shrinkage porosity defects in the localized region that would otherwise result.

One advantage of the present invention is that the chill body vaporizes upon contact with the molten metal rather than melting or remaining in tact as with prior art methods. In this way, the chill does not contaminate the casting metal or require removal following casting nor does it remain in tact with the casting to possibly affect the integrity of the article.

BRIEF DESCRIPTION OF THE DRAWINGS

Other advantages of the present invention will be readily appreciated as the same becomes better understood by reference to the following detailed description when considered in connection with the accompanying drawings, wherein.

DETAILED DESCRIPTION OF THE DRAWINGS

Figure 1:
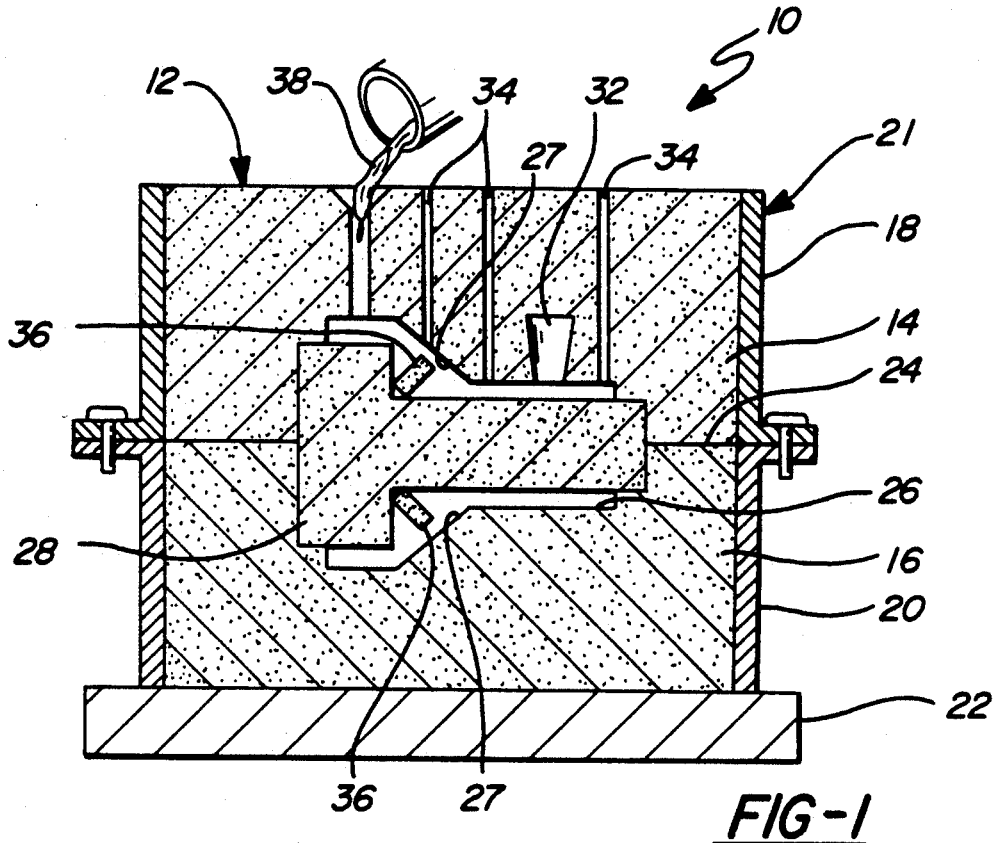
FIG. 1 is a cross-sectional view of a casting mold for practicing the subject invention.

A casting mold assembly for use in practicing the present invention is generally shown at 10 in FIG. 1 and includes a mold 12 having upper (cope) 14 and (drag) 16 mold portions disposed within respective cope 18 and drag 20 sections of a metal molding flask 21 and supported on a drag slab 22. The mold halves 14, 16 are joined along parting line 24 and define a mold cavity 26 therebetween.

The mold portions 14, 16 may be constructed of a number of different mold materials and according to conventional foundry mold practice. To prepare the mold 12 according to a preferred method, the cope and drag flask sections 18, 20 are disposed on appropriate pattern plates (not shown) having reversely contoured images of the cavity halves to be formed after which foundry sand (e.g., silica) together with suitable binder material is introduced into the flask sections 18, 20 and compacted against the pattern plates and cured to form the mold cavity 26 having the desired shape of the article to be cast therein.

The mold 12 includes an ingate passage 30 extending into the mold cavity 26 for admitting molten metal therein and a riser 32 serving as a reservoir for feeding remote still-molten metal to the various sections of the casting during solidification to compensate for solidification shrinkage. The mold sections 14, 16 may be gas permeable for venting the cavity 26 or provided with suitable air vents 34.

A suitable core 28 may also be provided within the cavity 26 for preserving the space it occupies as a hole or void in the resulting cast article. Depending upon the relative sizes and shapes of the cavity walls and core 28, the cavity 26 may have sections which are relatively thicker or larger in volume than other sections of the casting, as illustrated in FIG. 1 and indicated by the reference character numeral 27. The core 28 is constructed of conventional core materials, such as resin bonded sand, and according to conventional core making practice.

Figure 2:
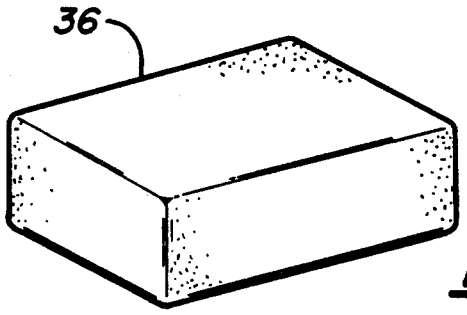
FIG. 2 is a prospective view of an expanded polystyrene chill member.

The relatively larger sections 27 of a mold cavity 26 have vaporizable chill members 36 accommodated therein. The chill members 36 (FIG. 2) are preferably fabricated of expanded polystyrene foam material, similar to that used for lost-foam casting patterns. The chills 36 have a characteristic heat of vaporization dependent upon the material selected for the chills 36 as well as the mass. The chills 36 may be of different shape and site to accommodate each particular application and would typically be of significantly less volume than the cavity 26.

To cast an article within the mold 12, the mold halves 14, 16 and core 28 are first prepared in the manner described above. One or more polystyrene chill members 36 is attached to the core 28 such as by wedging the chills 36 into crevices or corners of the core 28 as shown in FIG. 1.

The core 28 and chill members 36 are disposed within the cavity 26 of the mold 12 with the chill members 36 being located in the relatively larger sections of the cavity 26.

Molten metal 38 is then poured into the mold 12 through the in gate 30 to fill the mold cavity 26 and riser 32. The molten metal 38 may be of any type, such as iron or aluminum-based metal. As the metal fills the cavity 26, a portion of it comes into contact with the polystyrene chill members 36 and vaporizes them. This vapor escapes from the cavity 26 through the porous mold or air vents 34 so as not to contaminate the metal. The heat of vaporization of the chills 36 (i.e., the heat absorbed by the chills 36 to convert them from the solid state to the vapor state) rapidly cools a localized region of the molten metal adjacent the chill members 36 and accelerates solidification of these regions. In other words, the portion of the molten metal in the relatively larger cross-sectional areas 27 of the cavity 26 in which the chill members 36 ar located has a certain amount of heat extracted from it corresponding to the heat of vaporization of the chills 36. This extraction of heat lowers the temperature of the metal in this region and causes it to solidify sooner than it otherwise would if the chill members were not present. The effect of providing the chill members 36 is to balance the solidification times between the relatively large and smaller cross-sectional regions of the cavity 26 so that they solidify at about the same time. This prevents metal in the thinner sections of the cavity from solidifying first and thereby closing off the metal in the thicker sections from access to remote, still-molten metal from the riser 32.

Figure 3:
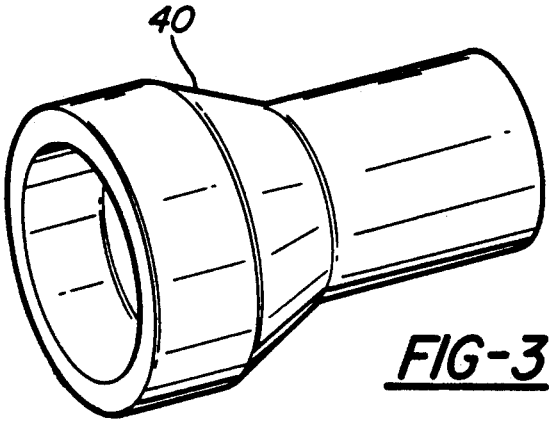
FIG. 3 is a perspective view of an article manufactured according to the process of the present invention.

The metal 38 is allowed to solidify within the mold 12 to form a resultant cast article 40 (FIG. 3) having the shape and size of the mold cavity 26 and is thereafter removed.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than is specifically described.

What is claimed is:

1. A method of eliminating solidification shrinkage porosity defects in the casting of metal articles, said method comprising:

preparing a casting mold (12) with a cavity (26) formed therein having at least a portion thereof that is susceptible to solidification shrinkage;

introducing molten metal into the cavity; and disposing a vaporizable chill member (36) within said portion of the preformed mold cavity (26)

prior to introducing the metal having a preselected characteristic heat of vaporization sufficient to rapidly cool and accelerate solidification of a localized region of the molten metal adjacent the chill member (36) enabling remote still-molten metal to feed solidification shrinkage of the localized region and thereby preventing formation of solidification shrinkage porosity defects in the localized region that would otherwise result.

2. A method according to claim 1 wherein the chill member (36) comprises polystyrene.

3. A method according to claim 1 wherein the casting mold (12) comprises a sand foundry mold.

4. A method according to claim 1 including disposing a casting core (28) within the cavity (26).

5. A method according to claim 4 including attaching the chill member (36) to the core (28) for support within mold cavity (26).

6. A method of preventing the formation of solidification porosity defects in the manufacture of a metal casting, said method comprising:

preparing a casting mold (12) having a cavity (26) with variable thickness sections formed therein;

casting molten metal into the cavity (26); and disposing a vaporizable chill member (36) within a thick section (27) of the preformed cavity (26)

prior to introducing the molten metal having a preselected heat of vaporization sufficient to rapidly cool the portion of molten metal within the thick section (27) of the cavity (26) adjacent the chill member (36) and accelerate its rate of solidification in relation to the portion of metal in other relatively thinner sections of the cavity (26) enabling remote still-molten metal to feed solidification shrinkage of the portion of metal in the thick section (27) and thereby preventing the formation of solidification porosity defects in this portion of metal which would otherwise form as a result of the metal in the relatively thinner sections of the cavity (26) solidifying sooner than that in the thick section (27) and closing off access of the remote still-molten metal to the portion of metal in the thick section (27) of the cavity (26).

7. A method according to claim 6 wherein the chill member (36) comprises polystyrene foam.

* * * * *